United States Patent [19]

Benton et al.

[11] 4,354,828

[45] Oct. 19, 1982

[54] METHOD AND APPARATUS FOR PRODUCING UNIFORMLY BAKED ANODES

[75] Inventors: Charles M. Benton; Homer M. Charlton, both of Owensboro, Ky.; Wade L. Van Winkle, Tell City, Ind.; Jerry A. Meyer, Owensboro, Ky.; Franklin D. Arnold, Owensboro, Ky.; Anthony Kamalich, Owensboro, Ky.

[73] Assignees: Southwire Company, Carrollton, Ga.; National Steel Corporation, Pittsburgh, Pa.

[21] Appl. No.: 245,006

[22] Filed: Mar. 18, 1981

[51] Int. Cl.[3] ..... F27D 7/00; F27B 9/40; F27D 19/00; F27B 9/00

[52] U.S. Cl. ..... 432/24; 432/37; 432/51; 432/145

[58] Field of Search ..... 432/24, 37, 51, 145

[56] References Cited

U.S. PATENT DOCUMENTS

| | | | |
|---|---|---|---|
| 3,666,393 | 5/1972 | Davies | 431/90 |
| 4,269,592 | 5/1981 | Benton et al. | 432/19 |
| 4,284,404 | 8/1981 | Genevois et al. | 432/37 |

*Primary Examiner*—John J. Camby

*Attorney, Agent, or Firm*—Herbert M. Hanegan; Stanley L. Tate; Robert Steven Linne

[57] ABSTRACT

A method and apparatus for automatically controlling a carbon bake furnace to thereby reduce uniformly baked anodes is disclosed. In its method aspects, the invention contemplates the use of flue and pit temperatures to produce a control signal to operate a valve for varying the air fuel mixture of a burner associated with said valve. In its apparatus aspects, the invention utilizes a plurality of infrared detectors to measure the pit and flue temperatures. The signals produced by these sensors are fed to a computer which produces a control signal for operating a valve associated with at least one of a plurality of burners which is to have its air/fuel ratio adjusted to thus adjust the temperature in the pit heated by the selected burner to a desired target temperature.

7 Claims, 6 Drawing Figures

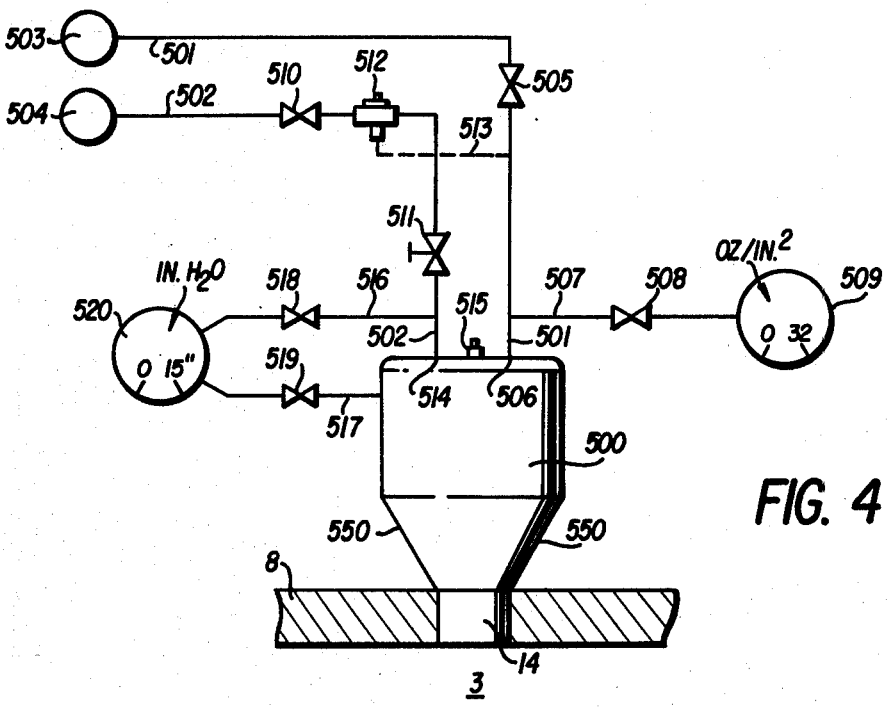
FIG. 4
FIG. 5
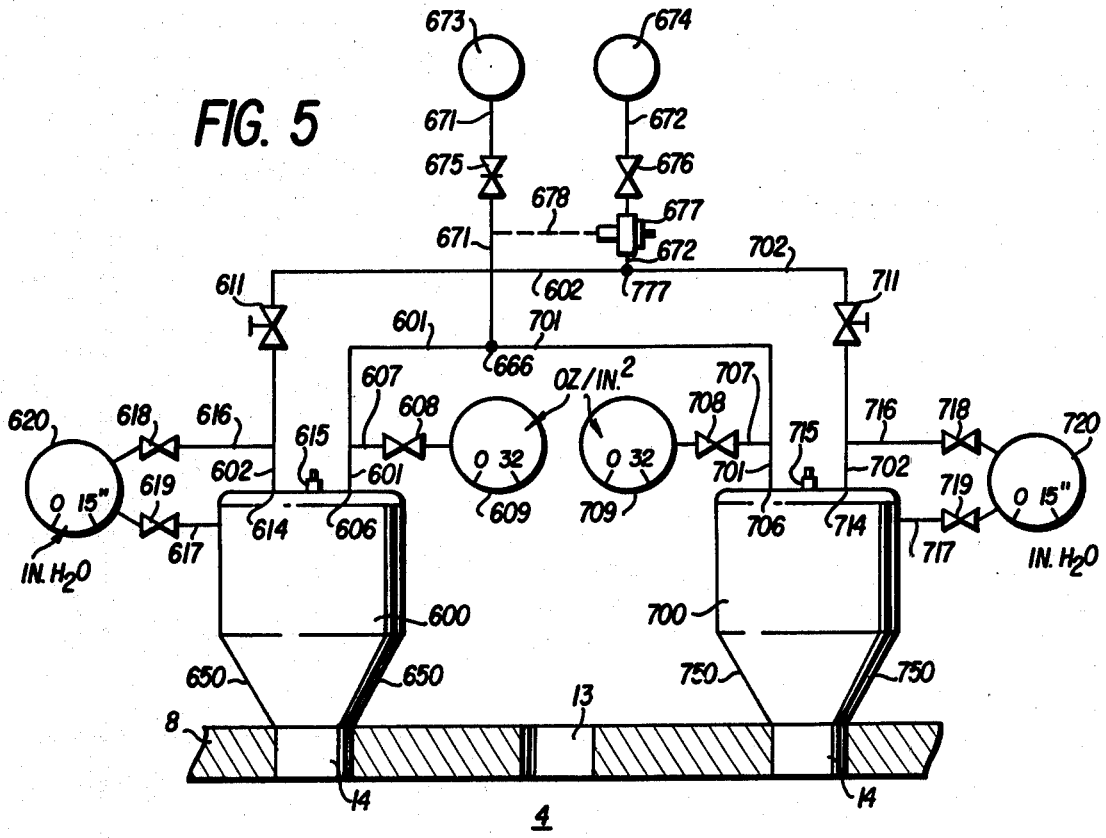

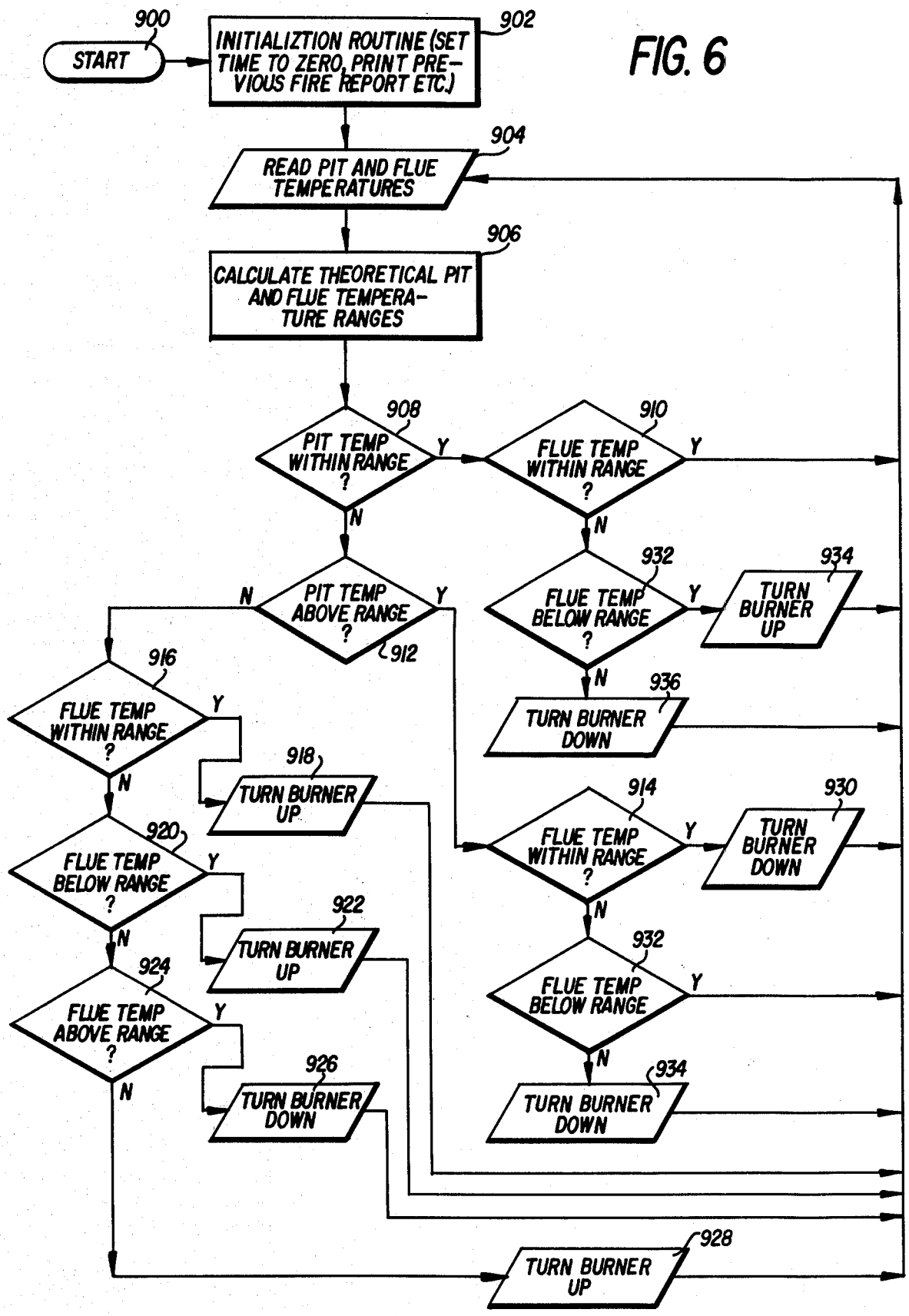
FIG. 6
900
START
902
INITIALIZTION ROUTINE (SET TIME TO ZERO, PRINT PRE-VIOUS FIRE REPORT ETC.)
904
READ PIT AND FLUE TEMPERATURES
906
CALCULATE THEORETICAL PIT AND FLUE TEMPERA-TURE RANGES
908
PIT TEMP WITHIN RANGE ?
910
FLUE TEMP WITHIN RANGE ?
912
PIT TEMP ABOVE RANGE ?
914
FLUE TEMP WITHIN RANGE ?
916
FLUE TEMP WITHIN RANGE ?
918
TURN BURNER UP
920
FLUE TEMP BELOW RANGE ?
922
TURN BURNER UP
924
FLUE TEMP ABOVE RANGE ?
926
TURN BURNER DOWN
928
TURN BURNER UP
930
TURN BURNER DOWN
932
FLUE TEMP BELOW RANGE ?
934
TURN BURNER UP
936
TURN BURNER DOWN
932
FLUE TEMP BELOW RANGE ?
934
TURN BURNER DOWN
Y
N

METHOD AND APPARATUS FOR PRODUCING UNIFORMLY BAKED ANODES

BACKGROUND OF THE INVENTION

1. Field of the Invention

This invention relates to production of carbon anodes for use in producing aluminum, and more particularly, to a method and apparatus for automatically controlling the baking temperature of the raw anodes within close tolerances to produce uniformly baked anodes.

2. Description of the Prior Art

The present invention, by producing uniformly baked electrodes, is directed to decreasing the air pollution resulting from said manufacturing process; decreasing the fuel consumption utilized in such manufacturing process; and improving the quality of the anode thus produced. The attainment of each of these goals, through the use of the present invention, results in substantial benefits to the user of the present invention and to persons living near where the invention is practiced.

Exhaust gases from smokestacks of industrial furnaces are often a major source of air pollution. Because of present national concern about air pollution, the U.S. Congress created the Environmental Protection Agency (hereinafter EPA). This agency has promulgated various regulations governing the permissible industrial emissions into the atmosphere. Most states have established similar agencies which have promulgated identical or more stringent regulations. For example, the Commonwealth of Kentucky has enacted Title 401, K.A.R. chap. 3:060 (3) (a) 1, which states that the emission of particulate matter into the open air must not exceed 40% opacity, that is, the emission must not block more than 40% of the light passing through it. Not all attempts to limit the emissions of particulate matter from anode baking furnaces into the atmosphere have been successful. This is due to the nature of the heating processes and combustion apparatus utilized in the industrial processes. However, other attempts have been more successful. See for instance, U.S. patent application Ser. Nos. 119,918, 119,919, now U.S. Pat. No. 4,279,052, and 119,920, now U.S. Pat. No. 4,269,592, all filed on February 8, 1980, and commonly assigned to the assignee herein. While the cited patent applications utilize improvements in an exhaust gas stream to achieve significant air pollution reduction, the present system, by automatically maintaining a predetermined desired anode baking temperature range, minimizes the hydrocarbons exiting from the plant smokestack.

In addition to national concerns about air pollution, it is also a national policy of the United States to conserve the amount of fossil fuel used in all sectors of the economy. Conservation, it has been argued, can extend existing energy supplies without the need for urgent exploration of additional fossil fuels. Accordingly, if a carbon anode bake ring furnace can be made to operate more efficiently with a lesser quantity of fossil fuel to produce the necessary heat, substantial reductions in fuel bills and pollution can be achieved. It has been calculated that approximately 44.1% of all energy inputted into a conventional carbon anode ring furnace is wasted. In fact, it has been determined that anodes produced by such a furnace consume only 21.6% of the total energy input into the furnace. By use of the present invention, the amount of wasted energy can be minimized. Thus, a very large reduction in fuel consumption can be attained, with the concomittant fuel cost savings.

The present invention is also directed to producing uniformly baked anodes of high quality and reproducibility. One of the factors which controls the ability to reproduce anode qualities is the temperature range within which the anode is baked. If the range of temperatures about a target temperature can be maintained within very small tolerances, for example, 1100° C. plus or minus 5° C., a substantially improved anode can be produced. For example, anodes that can be produced with a variation of 5° about this point, rather than 50° about this point, show an improvement in the range of finishing temperature by a factor of 10. As is well-known in the art, when utilizing such anodes, it is desirable that each anode have the same electrical resistance. This will cause the anodes to draw almost the same current and thus, in an electrolytic process for producing aluminum, produce a high purity product. The price obtained for this finished aluminum depends upon the percent purity of the finished product. The higher the purity, the greater the price obtained. Thus, it is to an aluminum producer's benefit to utilize anodes with as closely as possible the same resistance, in order to produce the highest purity end product, which in turn will bring the highest price.

As outlined above, the use of the present invention allows a carbon anode manufacturer to attain: reduced pollution; reduced fuel consumption and attendant fuel cost savings; and improved anode quality with attendant fuel cost savings; and improved anode quality with attendant higher purity aluminum produced and thus higher price obtained for the produced aluminum.

In the past, the uniformity of baked anodes depended directly upon the skill of firemen in controlling the baking process. Even with experienced firemen, a 50° range of finishing temperature is generally the best that can be expected.

In addition to using firemen to bake the anodes, another system is known in the art. This system does not utilize a burner; rather, it uses a very crude lance to produce the heat for the furnace. Secondly, this system utilizes thermocouples to measure flue temperatures of the furnace. The use of thermocouples is troublesome because of the high temperatures inside the furnace. The thermocouples are hung vertically, and do not have a long life in such an environment. Also, the thermocouples must be moved every time the firing frames are moved, which is every day or two. This also tends to shorten thermocouple life. For these reasons, the use of thermocouples in such a system to indicate furnace temperatures is impractical since a great number of replacements are required. Replacements are both expensive and require additional personnel time to effectuate. For these reasons, these systems are not often utilized. One known installation of such a system is at the Intalco Aluminum Company, in Bellingham, Wash.

Other exemplary prior art industrial furnaces for baking aluminum products are shown and described in U.S. Pat. Nos. 2,678,205 and 4,128,394. However, these furnaces are of the tunnel kiln type and not of the ring pit type. Also, these patents do not disclose that any attempt has been made to obtain the greatest possible fuel efficiencies, the least possible pollution of the outside atmosphere and a great uniformity in the finished carbon baked products, utilizing computer control of the baking furnace.

SUMMARY AND OBJECTS OF THE INVENTION

In view of the foregoing, it should be apparent that there exists a need in the art for a method and apparatus for producing uniformly baked electrodes in a fuel and cost efficient manner, while introducing the least possible pollution into the outside atmosphere. It is, therefore, a primary object of this invention to provide a method and apparatus for producing uniformly baked anodes in the most efficient manner possible, while utilizing the least possible amount of fuel. More particularly, it is an object of this invention to provide a method of controlling a carbon anode ring bake furnace as aforementioned having simple and reliable electronic circuitry which requires little maintenance.

Still more particularly, it is an object of this invention to provide a method and apparatus for producing uniformly baked electrodes, which electrodes produce the greatest possible purity of electrolyzed aluminum.

Another object of the present invention is to provide a method and apparatus for producing uniformly baked electrodes which utilize components capable of withstanding a carbon anode ring baking furnace environment.

A further object of the present invention is to provide a method for producing uniformly baked electrodes in which the temperature of the oven in which said electrodes are baked is carefully controlled so as not to vary more than a predetermined number of degrees from a desired target temperature.

A further object of the present invention is to provide a method and apparatus of producing uniformly baked electrodes wherein the pit and flue temperatures of the furnace are monitored. This information is utilized by a process computer to control the amount of heat supplied to the furnace, and thus operate said furnace on an optimum fuel usage and nonpollution-producing basis. Such operation results in the production of uniformly baked anodes of uniform resistance.

Briefly described, these and other objects of the invention are accomplished by providing a series of sensors for sensing the flue and pit temperatures of the furnace. The flue and pit temperature signals are fed through a multiplexer to a voltage to current converter, which then sends the signal through a current sensor to a computer. A small precision resistor is utilized as the current sensor because the process computer operates utilizing voltage inputs, rather than current inputs. The computer, based upon the input data, operates any one or none of a series of motors, each connected by means of a flexible coupling to an air control valve for each burner. The computer provides a digital signal which causes the motor to open the valve in small degree increments, thus increasing or decreasing the temperature in the selected pit by a small amount as it approaches the desired target temperature.

With these and other objects, advantages and features of the invention that may become hereinafter apparent, the nature of the invention may be more clearly understood by reference to the following detailed description of the invention, the appended claims and to the several drawings attached herein.

BRIEF DESCRIPTION OF THE DRAWINGS

FIG. 4 is a schematic view of a high velocity burner utilized in the third prebaking stage of the carbon products;

FIG. 5 is a schematic view of a plurality of high velocity burners utilized in the baking stage of the carbon products; and FIG. 6 is a flow diagram of the computer control system.

DETAILED DESCRIPTION OF THE PREFERRED EMBODIMENT

Figure 1:
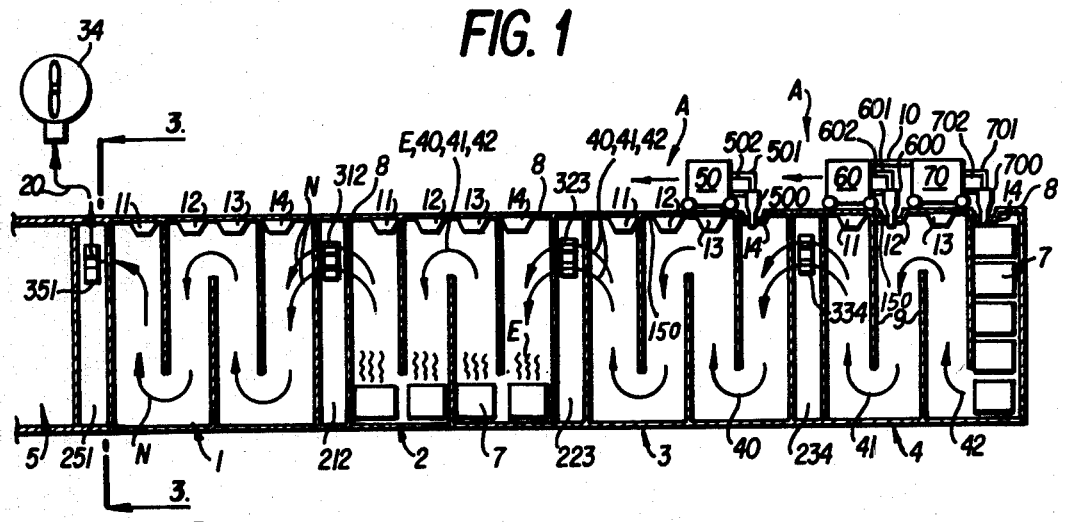
FIG. 1 is a side view taken through a plurality of furnaces forming adjacent links in an oval-shaped ring of furnaces utilized for baking carbon products.
Figure 2:
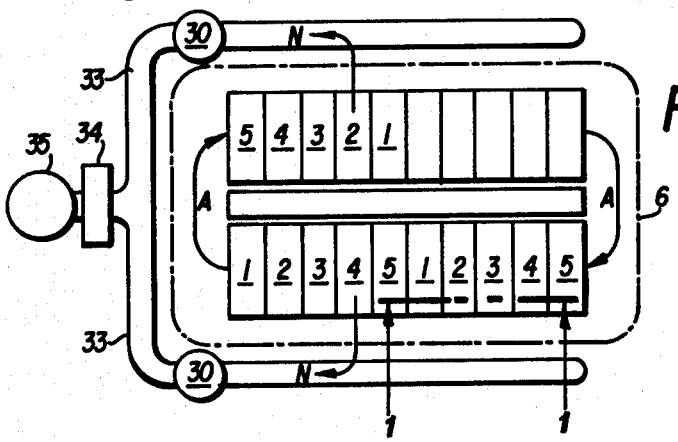
FIG. 2 is a top plan view of the furnaces forming the links of the oval-shaped ring.

Referring now in detail to the drawings, there is shown in FIG. 2 a plurality of furnaces 1–5 which form adjacent links in an oval-shaped ring 6 of furnaces arranged for baking therein stacked rows of carbon products 7 shown in FIG. 1. As seen from overhead in FIG. 2, the furnaces 1–5 are only five of many furnaces that give the ring 6 its oval shape. Each furnace is comprised of six pits and seven flues.

Each carbon product 7 may be a 1700 pound anode utilized as an electrical conductor to reduce alumina into aluminum in an electrorefining operation to be carried out elsewhere after the anode is baked. However, in order to first form the anode, it is necessary to hot press amorphous carbon that is bound into a block by a suitable pitch, such as coal tar, which consists of particulate matter and volatile hydrocarbons having molecular weight over 3,000. The carbon products 7 are stacked in rows in at least four furnaces 1–4 before the heating and baking processes begin. Such rows of carbon products 7 are shown partially arranged in furnaces 2 and 4 in FIG. 1. During the second prebaking stage carried out in furnace 2, the heated carbon products 7 give off an exhaust gas stream E consisting of the volatile hydrocarbons and particulate matter. See FIG. 1.

As shown in the side view in FIG. 1, each furnace 1–4 has a plurality of observation points or peepholes 11–14 which in the past have been used by the firemen for viewing the interior. As will be described hereinafter, the present invention utilizes said peepholes for the placement of temperature sensors. As shown in FIG. 1, each peephole row, for example, row 11, includes a plurality of individual peepholes arranged on the top 8 of each furance 1–4 in a row thereacross. Each row of individual peepholes is at ground level G and each furnace 1–4 is insulated at its sides and bottom by refractory bricks and earth. Each furnace 1–4 is divided from the adjoining furnace by a thick wall shown in FIG. 1 as 212, 223 and 234 made of refractory brick. In each wall 212, 223 and 234, there is shown an opening 312, 323 and 334, respectively, near the top 8 of the two adjoining furnaces so that heat transfer mediums 40, 41 and 42 and non-polluting compounds N may pass therethrough to the next furnace in the ring 6. Inside each furnace 1–4 there is a plurality of parallel, vertically oriented baffles 9. These baffles 9 form a W-shaped pattern within each furnace 1–4 so that the heat transfer mediums 40, 41 and 42 circulate completely and distribute heat evenly throughout each such furnace 1–4.

Travelling along the top 8 of the furnaces 1–4 is a plurality of racks 50, 60 and 70, shown in FIG. 1. As shown in FIGS. 1 and 2, these racks 50, 60 and 70 are moved in the direction of arrow A by suitable means around the cirumference of the oval-shaped ring 6 of the furnace.

As shown in FIG. 1, rack 50 carries a prebaking burner 500 which force-drafts the heat transfer medium 40 into peephole row 14 in furnace 3. An air line 501 and a fuel line 502 supply air and fuel, respectively, to the prebaking burner 500.

As shown in FIG. 1, racks 60 and 70 carry baking burners 600 and 700, respectively, which force-draft additional heat transfer mediums 41 and 42 into peephole rows 12 and 14, respectively, in furnace 4. Racks 60 and 70 are joined together by a joint 10 so that they travel in unison and are essentially a singular piece of equipment. Air lines 601 and 701 and fuel lines 602 and 702 supply air and fuel, respectively, to baking burners 600 and 700, respectively.

When racks 60 and 70 are moved along the top 8 of the furnaces, e.g., from furnace 4 to 3, rack 50 is also moved, e.g., from furnace 3 to 2. Likewise, exhaust manifold 20 is moved from furnace 1 to adjoining furnace 5. See FIG. 2.

A preferred unit for the high velocity prebaking burner 500 is manufactured by North American Manufacturing Company, Cleveland, Ohio, and is identified by model No. 4442A-4S. Preferred units for the high velocity baking burners 600 and 700 are manufactured by the same company and are identified by model No. 442A-4. Such models for both types of burners are the subject matter described and claimed in U.S. Pat. No. 3,666,393, issued on May 30, 1972, in the name of Theodore E. Davies and entitled "Burner, Structure and Method".

In the more detailed illustration of prebaking burner 500 in FIG. 4, compressed air source 503 supplies air line 501 while pressurized fuel source 504 supplies fuel line 502. A butterfly valve 505 is arranged in the air line 501 between the air source 503 and the point 506 through which the air exits air line 501 and enters prebaking burner 500. Air line 501 is also connected to an air test line 507 having therein an air test valve 508 leading to a pressure gauge 509 for measuring the air pressure, preferably in ounces per square inch (oz./in.$^2$).

Fuel line 502 has a safety valve 510 and an adjustable orifice valve 511 therein for adjusting or cutting off the flow of fuel to the prebaking burner 500 in an emergency. The type of fuel utilized by the prebaking burner 500 may be either natural gas or light fuel oil.

A regulator 512 is connected into fuel line 502, preferably between the safety valve 510 and the adjustable orifice valve 511, and maintains the air and fuel entering the prebaking burner 500 at a constant preset pressure ratio. The regulator 512 is activated by an impulse line 513 connected to the air line 501. The monitored fuel exits fuel line 502 at point 514 and enters prebaked burner 500. Push-button operated ignition switch 515 ignites the fuel/air mixture in the prebaking burner 500.

Just in front of point 514 there is an upstream fuel test line 516 connected into fuel line 502. Just beyond the point 514, there is a downstream fuel test line 517 connected into the prebaking burner 500. Upstream test line 516 and downstream test line 517 have test valves 518 and 519, respectively, connected therein and leading to a conventional magnehelic gauge 520 for measuring the difference in fuel pressure in inches of water (in. $H_2O$).

In the more detailed illustration of baking burners 600 and 700 in FIG. 5, compressed air source 673 supplies air lines 671 which divides at point 666 into air line 601 leading to baking burner 600 and air line 701 leading to baking burner 700. Pressurized fuel source 674 supplies fuel line 672 which divides at point 777 into fuel line 602 leading to baking burner 600 and fuel line 702 leading to baking burner 700. A butterfly valve 675 is arranged in the air line 671 between the air source 673 and the point 666. Air lines 601 and 701 are connected to air test lines 607 and 707, respectively, which have respective air test valves 608 and 708 leading to respective pressure gauges 609 and 709 for measuring the air pressure, again preferably in oz./in.$^2$. At point 606 and 706, air exits respective air lines 601 and 701 and enters respective baking burners 600 and 700.

Fuel line 672 has a safety valve 676 and fuel lines 602 and 702 have adjustable orifice valves 611 and 711, respectively, for adjusting or cutting-off the flow of fuel to the respective baking burners 600 and 700 in an emergency. The same type of fuel is utilized in baking burners 600 and 700 as is used in prebaking burner 500.

A single ratio regulator 677 is connected into fuel line 672, preferably between safety valve 676 and the point 777. Thus, the need for two ratio regulators in each fuel line 602 and 702 is eliminated. The regulator 677 maintains the air and fuel in the baking burners 600 and 700 at a constant preset pressure ratio and is activated by an impulse line 678 connected to the air line 671. The monitored fuel exits fuel lines 602 and 702 at point 614 and 714, respectively, and enters respective baking burners 600 and 700. Push button-operated ignition switches 615 and 715 ignite the air/fuel mixture in respective baking burners 600 and 700.

Just in front of the point 614 and 714, there are upstream fuel test lines 616 and 716 connected into respective fuel lines 602 and 702. Just beyond the point 614 and 714, there are respective downstream fuel test lines 617 and 717 connected into the respective baking burners 600 and 700. Upstream fuel test lines 616 and 716 and downstream fuel test lines 617 and 717 have test valves 618, 718, 619 and 719, respectively, connected therein and leading to respective conventional magnihelic gauges 620 and 720 for measuring the difference in fuel pressure in inches of water (in. $H_2O$).

Figure 3:
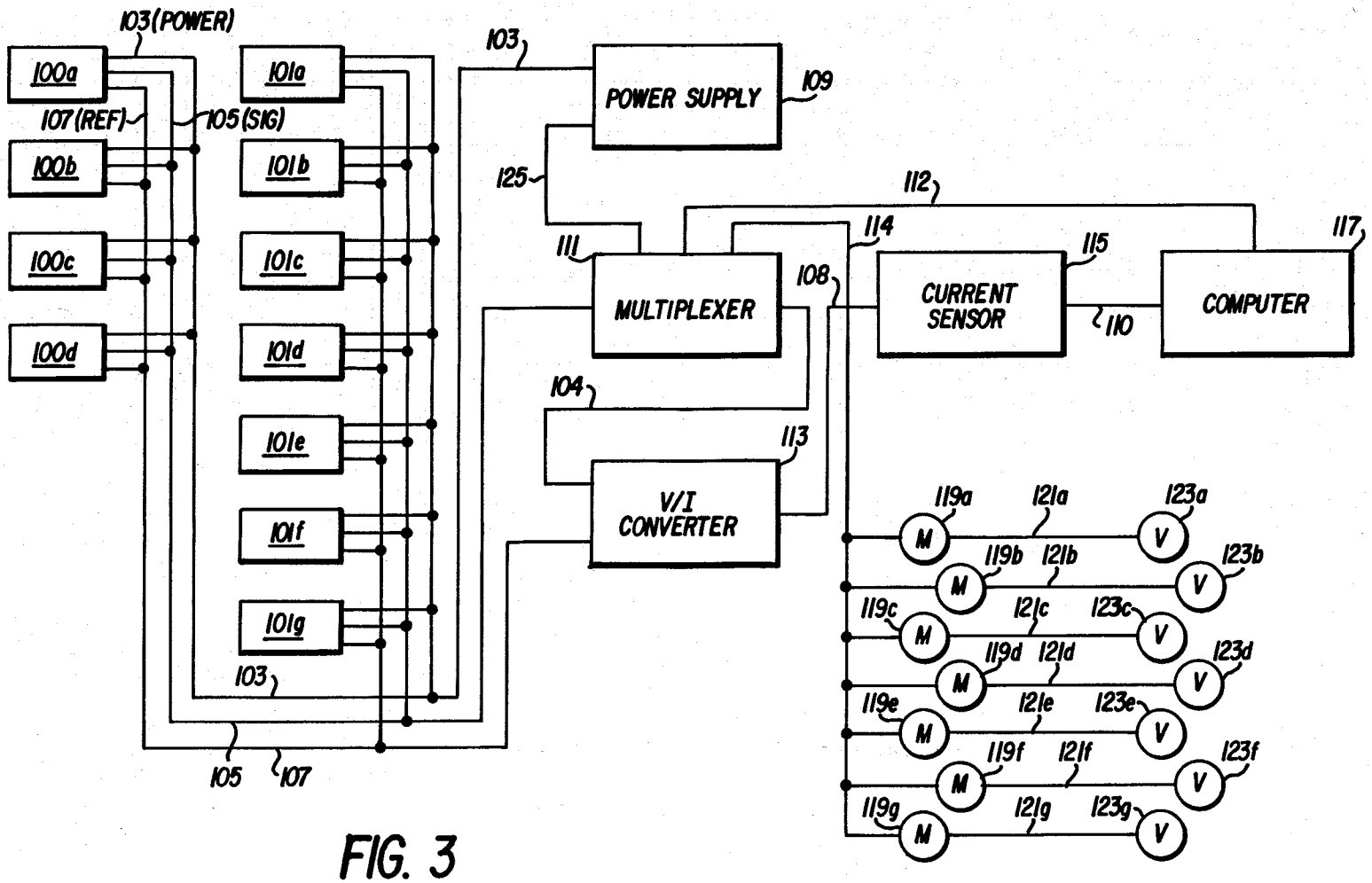
FIG. 3 is a block diagram of the control system of the present invention.

FIG. 3 illustrates the preferred embodiment of the control system for automatically controlling the furnace to produce uniformly baked anodes. However, even though the present invention contemplates the automatic maintenance of desired target temperatures within the furnace, it is still necessary to utilize two firemen, as will be described hereinafter, to operate the furnace in conjunction with the present inventive method and apparatus. In FIG. 3 there is shown a plurality of infrared temperature detectors **100*a–d* which are utilized to measure pit or anode temperatures. The purpose of these detectors 100*a–d* is to take the temperatures of the anodes. For this purpose, four graphite tubes 150 (only two are shown in FIG. 1) are inserted in the packing medium of the furnace on the center line on the top layer of anodes. Each of the four sensors 100*a–d* is placed into its respective graphite tube. These sensors may preferably be infrared optical detectors which utilize a silicon detector to measure temperatures. Each preferably sees a circle of 0.387 inch diameter at 36 inches. Since the temperatures to be detected are below 1000° C., thermocouples could also be used to measure pit temperatures, instead of infrared detectors 100*a–d*. Thus, the target temperature of the anodes is taken at 36 inches down in the packing medium on the center line on the top layer of anodes. Each detector additionally contains a compensation preamplifier. Although there are six pits in which seventy-two anodes are being baked, only four sensors are utilized in order to determine the temperatures of the anodes. For this reason, the temperatures in pits 2 and 5 are calculated by averaging the temperatures of pits 1 and 3 and 4 and 6**, respectively.

A plurality of sensors 101*a*–101*g* is provided for measuring the flue or brick temperature of each of the seven flue walls of the furnace. These sensors are also infrared detectors, also utilize silicon detectors, but have a field of view of 6.8 inches in diameter at 72 inches away. Thus, a much larger field of view is seen by these sensors. They also contain a temperature compensation preamplifier.

Each of the infrared detectors 100*a–d* and 101*a–g* are connected via a power line 103 to a power supply 109. This power supply produces the plus and minus 15 volts DC necessary for the operation of the infrared detectors. The output of each sensor is transmitted via line 105 to a multiplexer 111. A multiplexer is utilized so that the computer can individually address each of the eleven sensors. Finally, each of the infrared detectors has a common signal line 107. This serves to eliminate electrical noise in the system. Line 107 feeds into a voltage-current converter 113, as does a line 104 from the multiplexer 111. These two signals leave the converter 113 as a current signal on line 108 and feed into a current sensor 115 which may be a precision resistor. The use of a precision resistor as current sensor 115 is necessary because the computer 117, which may preferably be a Modacs III, manufactured by Mod-Comp, utilizes voltage signals, rather than current signals, as inputs. A power supply line 125 is connected between the power supply 109 and the multiplexer 111 for use in actuating the motors 119*a–g*. The multiplexer 111 is also connected to a plurality of motors 119*a*–119*g* via a control line 114 and additionally to the output of the computer 117 by line 112. Thus, when the computer determines that a motor should be incremented, it sends a signal to the multiplexer 111, selecting the proper motor. The multiplexer then connects the selected motor to the power supply 109 and the motor is activated by a signal on line 114.

The purpose of each of the motors is to control an individual one of a plurality of air valves 123*a–g* (in FIG. 3) which either increase or decrease the amount of air reaching the burners and, because a constant air to fuel ratio is maintained by the regulators 512 and 677, serves to increase or decrease the temperature produced by the burners 500, 600 and 700. The regulator 512 maintains the desired air/fuel ratio via the use of impulse line 513 and correspondingly, the regulator 677 maintains the proper air fuel ratio by the use of impulse line 678. The plurality of valves 123*a–g* represent the butterfly valves 505 (of FIG. 4) and 675 (of FIG. 5), which are used to control the air supply to the burners 500 and 600 and 700, respectively. Each of the motors 119*a–g*, which may preferably be DC gear motors, in-line series 500 miniature PMDC, 12-4, with one external lead, as manufactured by Allegretti-Rowe, Incorporated, operates its respective valve by use of a flexible cable 121*a–g*. These motors 119*a–g* are geared down in a ratio of 911/1 and may be each respectively given a signal of 0.1 second duration by computer 117 along line 112. Such a signal will cause the motors to move the butterfly valves through one and one-half degrees of rotation. It is contemplated that these small adjustments will be made every 15 minutes in order to provide precise control of the anode temperatures.

In operation, the computer sequences through all eleven sensors 100*a–d* and 101*a–g* every three minutes to take the anode and brick temperatures. The computer analyzes these eleven pieces of information and determines, utilizing the following formulas, whether any corrections are necessary to meet the target temperatures for the anodes.

$$\text{Preheat Pit Temperature} = 502.5^\circ\text{ C. } (1 - \cos\phi) + 70^\circ\text{ C.} \pm 10^\circ\text{ C., where } \phi = \frac{(2 \times \text{Firing speed} + \text{firing age}) \times \pi}{3.845 \times \text{Firing speed}} \quad (1)$$

The computer 117 will make a burner adjustment based on this firing curve within a range of ±10° C. Pit temperatures take precedence over flue temperatures where a contradictory burner adjustment is called for (that is, hot pit and cold flue or cold pit and hot flue). Where the flue temperature exceeds 1300° C., the flue temperature will take precedence over the pit temperature. The firing speed and firing age can vary from 46 to 52 hours. The firing speed is a constant in the equation (1) that may be changed from time to time. The firing age will start from 0 when a fireman resets a thumb wheel counter (not shown) which instructs the computer that a new fire has begun.

$$\text{The Preheat Flue Temperature} = 600^\circ\text{ C. } (1 - \cos\phi) + 70^\circ\text{ C.} \pm 20^\circ\text{ C. for the first 23 hours, where } \phi = \frac{(2 \times \text{Firing speed} + \text{firing age}) \times \pi}{2.5\ \text{Firing speed}} \quad (2)$$

This is because the preheat flue temperature target is 1270° C. after 23 hours. Burner adjustments are made within a ±20° C. range of the preheat flue temperature equation as long as the pit temperature is in range. The firing speed is a preset constant which again will vary from 46 to 52. The firing age is the dependent variable in this equation (2). It starts from 0 when the fireman resets the thumb wheel and continues to increase with time until the thumb wheel is again reset to 0.

$$\text{The Bake Pit Temperature} = 502.5^\circ\text{ C. } (1 - \cos\phi) + 70^\circ\text{ C.} \pm 5^\circ\text{ C.} \quad \phi = \frac{(3 \times \text{Firing speed} + \text{firing age}) \times \pi}{3.845\ \text{Firing speed}} \quad (3)$$

The same logic as was described for the preheat temperatures is utilized for the bake pit temperature.

$$\text{The Bake Flue Temperature} = 600^\circ\text{ C. } (1 - \cos\phi) + 70^\circ\text{ C.} \pm 10^\circ\text{ C., where } \phi = \frac{(3 \times \text{Firing speed} + \text{firing age}) \times \pi}{3.666 \times \text{Firing speed}} \quad (4)$$

For the first 31 hours, this equation is used for the bake flue temperature control. After 31 hours, the flue temperature target is 1270° C.

Thus, after the computer has determined, according to the foregoing four equations, that a temperature correction is necessary, it transmits a 0.1 second duration digital pulse to the correct motor for controlling the valve connected to the burner in which pit the temperature correction is to be made. Initially, all of the valves 123*a–g* are set in their full open position so that the computer can maintain a record of the current position of each valve. The opening of all of the valves 123*a–g* is accomplished by the fireman, either by manually opening of the valves or by a push-button which instructs the computer to open all of the valves. The fireman is also needed in order to start each of the burners by the use of the switches ignition 515, 615 and 715 and, in addition, to moving the racks along the furnace itself. It should also be noted that all of the sensors and the multiplexer are carried directly on the racks 50, 60 and 70, with only a power line, a computer multiplexer line and a gas line running to each rack. In order to control the furnace, rack 50 and combined racks 60 and 70 can have individual burners, detectors and multiplexers associated therewith.

The computer 117 will control the burners all the time from the start of the fire by the fireman. During the first eleven hours of the preheat I stage, before the computer can actually see the pit temperatures by use of the infrared detectors 100*a–d*, the computer 117 will use the signals from the flue brick infrared detectors 101*a–g* to control the burners. After a fire has been completed, a complete print-out of all of the adjustments made by the computer can be made.

The above-described furnace also utilizes a manual system for setting the proper air draft being exhausted from the furnace. This system is manually adjusted by the fireman until a predetermined desired exhaust draft range is achieved. The exhaust draft control system is not interfaced with the computer 117.

FIG. 6 shows the flow diagram utilized by the computer 117 for each pit. The motors in each of the pits are started four hours apart. At start 900, the computer goes into an initialization routine 902 in which time is set to 0, previous fire reports are printed, and other bookkeeping functions accomplished. Then at 904, the pit and flue temperatures are read. Next at 906, the computer calculates the theoretical pit and flue temperature ranges as discussed above. Then at 908, the computer queries whether the pit temperature is within the theoretical calculated range. If the answer is yes, the computer next, at 910, queries whether the flue temperature is within the calculated range. In the event that the pit temperature is not within the calculated range, the computer then, at 912, queries whether the pit temperature is above range. Regardless of whether the answer at 912 is yes is no, the computer then proceeds to query whether the flue temperature is within range, shown at 914 and 916. In the case of where the pit temperature at 912 is not above the calculated range and the flue temperature at 916 is within the calculated range, the computer then would turn the burner for that pit up, i.e., at 918 increase its temperature. If the pit temperature is queried at 912 and is determined not to be above its calculated range and the flue temperature at 916 is not within its calculated range, the computer next queries at 920 whether the flue temperature is below its range. If the flue temperature is below its range, then the burner is also turned up at 922. However, if the flue temperature at 920 is not below its range, the computer queries at 924 whether the flue temperature is above its maximum range. If the answer is yes, then the burner is turned down 926. If the answer is no, then the burner is turned up 928.

In the event that the pit temperature is queried at 912 and is determined to be above its range, and the flue temperature is queried at 914 and it is determined that the flue temperature is within its range, then the burner is turned down at 930. However, where the flue temperature is determined at 914 not to be within its range, the computer next queries at 932 whether the flue temperature is below its range. If the answer is yes, then the computer has completed its loop and starts again at 904 reading the pit and flue temperatures. If the answer is no, the burner is turned down at 934 before the computer returns to 904.

Finally, where the pit temperature is determined to be within its calculated range at 908 and the flue temperature is determined to be within its calculated range at 910, the computer then loops back to again read the pit and flue temperatures at 904. But, where the pit temperature is determined to be within its calculated range and the flue temperature is not determined to be within its calculated range at 910, then the flue temperature is queried at 932 to determine whether it is below its calculated range. In the event that the answer to that query is yes, then the burner is turned up at 934. Where the answer to that question is no, the burner is turned down at 936. In any event, once a burner has been turned up or turned down, then the computer again reads the pit and flue temperatures at 904 and goes through another cycle.

Although only a preferred embodiment is specifically illustrated and described herein, it will be appreciated that many modifications and variations of the present invention are possible in light of the above teachings and within the purview of the appended claims without departing from the spirit and intended scope of the invention.

What we claim is:

1. In a method for controlling the baking cycle of a carbon anode ring furnace of the type having a series of baking pits connected by heating flues in which heat is introduced into at least one of said pits by burners communicating therewith, said burners being of the type which combine and combust a variable air flow with a constant ratio of gaseous fuel, while succeeding pits are heated by hot products of combustion flowing through the connecting flues in order to maximize the thermal efficiency of the furnace and to produce uniformly baked carbon anodes of uniform electrical resistivity, the improvement comprising:

(a) detecting the temperatures of those baking pits and also the connecting heating flues of said furnace being fired; and transmitting corresponding pit and flue temperature signals to a computing means which contains preselected target profiles of said temperatures verses time;

(b) computing a plurality of control errors by comparing said pit and flue temperatures with current values calculated from said preselected target temperature-time profiles, respectively; and, if said temperatures are not substantially equal to the values calculated by said preselected profiles, then computing a control action for each of the burners of said furnace corresponding to said errors, respectively;

(c) controlling the air flow to said burners in response to said computed control action, respectively; further provided that said burners are regulated to maintain a constant air/fuel ratio; and (d) repeating the foregoing steps at selected frequent intervals throughout the baking cycle to control said pit and flue temperatures within a close tolerance band about said temperature-time target profiles, respectively, thereby substantially duplicating the intended baking cycle to produce anodes of substantially uniform resistivity.

2. The method of claim 1 wherein said temperature detection comprises detection and analysis of the infrared radiation emitted from the hot walls of the pits and flues.

3. The method of claim 1 wherein said control action is computed subject to an overall control strategy as follows: if the detected pit temperature is above its target temperature, then reduce the air flow to those burners; if the detected pit temperature is below its target temperature, then increase the air flow to those burners unless the detected flue temperature is above its target temperature in which case, decrease the air flow to those burners; and finally if the detected pit temperature is substantially equal to its target temperature, then increase said air flow if the detected flue temperature is below its target temperature, and decrease said air flow if the detected flue temperature is above its target temperature, thereby giving pit temperatures precedence over flue temperatures in the event a contradictory burner adjustment is indicated, except in those situations where flue temperature exceeds a pre-selected maximum.

4. The method of claim 1 wherein said air/fuel ratio for each of said burners is selectively preset considering emissions control, fuel efficiency, and control response.

5. The method of claim 1 wherein the tolerance band for said pit temperatures during baking is +/−5° C.

6. In apparatus for controlling the baking cycle of a carbon anode ring furnace of the type having a series of baking pits connected by heating flues and burners communicating with at least one of said pits, said burners having a variable air flow supply and a gaseous fuel supply for heating said pit to produce uniformly baked carbon anodes of substantially uniform electrical resistivity, the improvement comprising:

(a) means for detecting the temperatures of those baking pits and heating flues of said furnace being fired; and for transmitting corresponding pit and flue temperature signals to computing means;

(b) means for computing a plurality of control errors by comparing said pit and flue temperature signals with target values which are calculated from preselected and stored temperature-time profiles, respectively; and for computing a control action for each of the burners of said furnace corresponding to said errors, respectively; and (c) means for controlling the air flow to said burners in response to said computed control action, respectively; further provided that said burners are regulated according to constant air/fuel ratio.

7. The apparatus of claim 6 wherein said temperature detection means comprise an infrared detector which views the hot interior walls of said pits and flues.

* * * * *